United States Patent [19]

Bassett et al.

[11] Patent Number: 4,755,273

[45] Date of Patent: Jul. 5, 1988

[54] COVER FOR COATING TANKS

[76] Inventors: I. Jay Bassett, 508 Fountain, N.E., Grand Rapids, Mich. 49503; Leo L. Case, 3045 Middleton Ct., Troy, Mich. 48084

[21] Appl. No.: 911,111

[22] Filed: Sep. 24, 1986

Related U.S. Application Data

[62] Division of Ser. No. 815,822, Jan. 2, 1986, Pat. No. 4,663,014.

[51] Int. Cl.[4] ..... C25D 13/06; B05C 3/00; B05C 11/00

[52] U.S. Cl. ..... 204/299 EC; 118/423; 118/429; 118/428; 118/501

[58] Field of Search ..... 204/299 EC, 300 EC, 204/198, 199; 366/347; 202/242, 244; 118/423, 428, 429, 501; 220/213, 252, 253, 255, 260

[56] References Cited

U.S. PATENT DOCUMENTS

| | | | |
|---|---|---|---|
| 329,026 | 10/1885 | Vergne, Jr. | 220/252 |
| 581,052 | 4/1897 | Woolf | 68/13 R |
| 1,069,993 | 8/1913 | Amos | 204/269 |
| 1,392,780 | 10/1921 | Marsh et al. | 134/13 |
| 1,556,045 | 10/1925 | Swain et al. | 204/203 |
| 2,104,678 | 1/1938 | Sorensen | 204/58 |
| 2,232,803 | 2/1941 | Rodda | 141/9 |
| 2,251,121 | 7/1941 | Daw | 214/17 |
| 2,289,967 | 7/1942 | Johnson et al. | 29/81 |
| 2,651,312 | 9/1953 | McBeth | 134/122 |
| 2,689,198 | 9/1954 | Judd | 134/30 |
| 2,710,832 | 6/1955 | Harr | 204/48 |
| 2,864,526 | 12/1958 | Buss | 220/252 |
| 3,123,543 | 3/1964 | Chapman, Jr. et al. | 204/28 |
| 3,162,338 | 12/1964 | Grubelic | 366/347 |
| 3,200,057 | 8/1965 | Burnside et al. | 204/181 |
| 3,300,400 | 1/1967 | Burnside et al. | 204/181 |
| 3,399,126 | 8/1968 | Turner | 204/181 |
| 3,409,531 | 11/1968 | Ryerson et al. | 204/198 |
| 3,476,666 | 11/1969 | Bell et al. | 204/181 |
| 3,479,260 | 11/1969 | Rauch, Jr. et al. | 204/56 |
| 3,496,082 | 2/1970 | Orem et al. | 204/181 |
| 3,592,755 | 7/1971 | Thornton | 204/299 |
| 3,730,866 | 5/1973 | Madejczyk | 204/181 |
| 3,749,613 | 7/1973 | Augustine | 148/6.21 |
| 3,756,935 | 9/1973 | Thornton | 204/181 |
| 3,784,460 | 1/1974 | Le Bras et al. | 204/301 |
| 3,951,775 | 4/1976 | Horton et al. | 204/299 EC |
| 3,968,013 | 7/1976 | Boynton | 202/170 |
| 4,005,000 | 1/1977 | Kraska | 204/181 |
| 4,180,417 | 12/1979 | Oka et al. | 148/6.15 |
| 4,196,023 | 4/1980 | Rowe | 148/6.15 |
| 4,224,131 | 9/1980 | Acero et al. | 204/274 |
| 4,263,122 | 4/1981 | Urquhart | 204/300 |
| 4,284,493 | 8/1981 | Case et al. | 204/299 |
| 4,364,975 | 12/1982 | Cork et al. | 118/429 |
| 4,392,934 | 7/1983 | Viellefont et al. | 204/198 |
| 4,425,211 | 1/1984 | Birkle et al. | 204/198 |
| 4,457,441 | 7/1984 | McCloughan | 220/5 |

FOREIGN PATENT DOCUMENTS

| | | |
|---|---|---|
| 677815 | 12/1964 | Italy . |
| 1022005 | 12/1963 | United Kingdom . |

*Primary Examiner*—John F. Niebling
*Assistant Examiner*—Ben C. Hsing
*Attorney, Agent, or Firm*—Price, Heneveld, Cooper, DeWitt & Litton

[57] ABSTRACT

A cover especially adapted for use with electrodeposition coating tanks is disclosed for preventing contamination of the liquid coating material in the tank, reducing evaporation of coating liquid solvent from the tank, preventing condensate dripping and spoilage of parts within the tank, and providing easy access to the tank interior for maintenance purposes. The cover includes a curved configuration extending over the tank from the tank sides and at least one movable panel for access to the tank interior. The movable panel or panels are preferably curved to match the cover configuration and may be transparent for visibility into the tank without opening the cover.

5 Claims, 5 Drawing Sheets

COVER FOR COATING TANKS

This is a division of Ser. No. 815,822, filed Jan. 2, 1986 now U.S. Pat. No. 4,663,014.

BACKGROUND OF THE INVENTION

This invention relates to electrodeposition coating systems using liquid coating materials contained in tanks wherein the coating liquid is electrically charged and workpieces which are moved through the tanks for coating are oppositely charged. More particularly, the invention is an improved electrodeposition coating apparatus which provides an enhanced and improved electrically deposited coating on the workpieces through improved circulation of the liquid coating material within the holding tank and improved electrical charging capabilities coupled with reduced electrical power requirements.

In the automobile, metal office furniture and other industries using metal parts, advancements in the painting of metal parts have occurred in recent years. A well accepted painting method in such industries is that of electrodeposition of coating materials on metallic parts, which are usually charged positively while the liquid coating material is negatively charged. As a result, the coating material is attracted to and strongly adhered to the metal part. Especially in automobile parts, which are typically exposed to extreme weather conditions and corrosive atmospheres, electrodeposition painting or coating provides significantly better corrosion resistance, namely, at least three to five times better than parts painted with previously known methods.

In many conventional electrodeposition coating systems, water borne paint pigment such as a resin is kept in solution by circulation of the liquid within the painting tank. The water based coating material must conduct electricity therethrough to the items to be painted which are supported within the tank. Accordingly, numerous structures for accomplishing these purposes have been used and proposed including U.S. Pat. Nos. 2,710,832 to Harr, 3,496,082 to Orem et al. and 3,592,755 to Thornton which exemplify conventional apparatus for mounting electrodes within electrolytic deposition tanks and circulating the coating liquid within the tank.

Circulation of the liquid coating material within the electrolytic deposition tank has been a significant problem in many prior structures, however. Electrodes required for charging the liquid coating material have been positioned within the tank and connected to piping also contained within the tank in such a way that flow through the tank for circulation of the liquid and maintenance of the paint solution has been severely disrupted. Also required within the tank were rails and other protective structure to guard the electrodes from damage. This also disrupted circulation. The mounting of the electrodes, piping and protective structure within the tank has also restricted the work area available for painting within the tank. These combined problems have severely affected painting quality.

Additional problems with previously known paint systems include relatively high electrical power requirements needed to charge the coating material for proper paint adherence to workpieces being painted. The prior known tank structures required significant distances between the workpieces and the electrodes because of the requirements for positioning the electrodes and circulation equipment within the tank. Maintaining the electrical charge over such distances required relatively high electrical "throw-power". Moreover, many of the tanks which utilized liquid coating material circulation apparatus provided inadequate protection for the circulation equipment within the tank. When heavy parts being painted fell from supporting racks within the tank, the circulation equipment was often damaged by the falling or sinking objects. Thus, circulation within the tank was further disrupted.

Yet another problem was the contamination of the liquid coating material within the tank during use. Many prior known electrodeposition coating systems do not include covers over the tank area. This allowed the entry of dirt, foreign objects and other contaminants into the tank causing problems in maintaining the coating material in a proper state for good adherence and coating quality. Further, since the coating material was charged with electricity and thereby increased in temperature during operation of the coating apparatus, those tanks which were covered often encountered condensation problems on the covers causing dripping on the painted articles and reducing overall paint quality.

The present invention was conceived and made in recognition of the above and other problems in electrodeposition coating and provides significant advantages over prior systems.

SUMMARY OF THE INVENTION

Accordingly, the present invention provides an improved electrodeposition coating apparatus for applying a liquid coating material to a supported article wherein opposite electrical charges are applied to the workpiece and coating material. Improved liquid circulation apparatus is included along with provision for recessed, protected electrode assemblies so that overall flow disruption and turbulence is minimized for improved coating quality.

In one aspect, the apparatus includes a tank having spaced sidewalls, spaced end walls and a bottom forming an interior liquid holding area. A plurality of columns at spaced positions along each of the walls project into the interior of the tank along the height of the sidewalls at each position. These columns define recessed electrode receiving areas within the tank along the sidewalls. Liquid circulation means within the tank are provided for circulating liquid through and along the tank interior. When filled with a liquid coating material and provided with electrodes for applying an electrical charge to the coating liquid which are adapted to be received in the electrode receiving areas defined by the columns, the circulation means provide a flow of the coating liquid within the tank past the columns and the electrode receiving areas without substantial disruption or turbulence.

In other aspects of the invention, a plurality of electrodes are mounted adjacent the inside of each of the sidewalls between the columns such that they extend inwardly beyond the tank sidewalls no further than the innermost surfaces of the columns. The columns themselves are outwardly opening, hollow channels defining conduit passageways on the outside of the tank which receive piping forming both a part of the liquid circulation system and the system which circulates anolyte liquid to the electrodes.

In another aspect, the liquid circulation apparatus directs coating liquid toward a liquid level controlling weir at one end of the tank along the top of the tank, and away from the weir end at the bottom of the tank. Flow directing eductors project from the sidewall columns within the tank at spaced vertical positions and along the bottom to enhance flow within the tank. Further, in the preferred embodiment, the end walls are sloped outwardly and include liquid directing nozzles in stepped areas which project the coating liquid downwardly at the weir end and upwardly at the opposite end of the tank.

At the weir end of the preferred tank, a second, recirculation tank is positioned adjacent the main tank for receiving liquid overflow from the weir. Low liquid turbulence at the weir end avoids foam in the liquid which otherwise would lower painting or coating quality. The separate tank provides a mounting for pumps which recirculate the liquid back to the main tank and provide for easy maintenance access to those pumps and a convenient, easily attached collection point for the overflow liquid.

In yet other aspects of the invention, the sidewalls of the coating tank are assembled from several components including the sidewall columns, side panels extending between the columns, and reinforcing members extending along the outside of the tank and attached to the side panels and columns. Preferably, a liquid-tight, insulating liner is provided within the tank. This construction allows on-site assembly in plants without requiring prior, complete fabrication at a factory location and consequent difficulty in shipment to the desired site location. It also avoids painstaking welding of liquid-tight joints between columns, side panels and reinforcing members through use of an internal liquid-tight lining.

In another aspect of the invention, a curved cover is provided over the tank to prevent contamination of the coating material within the tank and reduce evaporation of coating liquid solvent from the tank. A series of curved glass panels are slidably mounted in a curved framework over the tank and may be slid upwardly for close and easy access to the interior of the tank and/or removed for cleaning or cleaning of the tank itself. The curved cover provides good visibility of operations within the tank and also prevents dripping of condensation which might collect thereon by allowing any condensation to flow downwardly along the cover and back into the tank.

The improved electrodeposition coating apparatus provides numerous advantages over prior known systems. The tank has increased circulation efficiency and improved protection for flow directing means and electrodes within the tank while requiring a smaller liquid capacity. Improved circulation of the liquid coating material within the tank is obtained because of the recessed electrodes and the vertically spaced flow directing eductors coupled with the removal of virtually all piping from the interior of the tank due to positioning in the sidewall columns and beneath the tank. The increased circulation and smaller tank capacity not only maintains a better coating solution and allows better coating application to workpieces supported within the tank but also tends to improve "throw-power" for charging the coating liquid and tends to require a lesser amount of electrical energy because of the closer spacing of workpieces to the charging electrodes for the coating liquid.

Construction of the coating tank is significantly easier because it may be assembled to the desired size from standard column, side panel and reinforcing member components on-site. The recirculation tank, which easily bolts onto the weir end of the coating tank, provides ease of installation of the recirculation pumps for maintenance and assembly. The flow directing eductors and nozzles within the tank are protected against damage from falling heavy parts within the tank, while the coating liquid itself is protected from contamination by a curved cover which also provides improved visibility and ease of access to the tank and ease in cleaning the cover while reducing coating liquid evaporation and condensation dripping.

These and other objects, advantages, purposes and features of the invention will become more apparent from a study of the following description taken into conjunction with the drawings.

BRIEF DESCRIPTION OF THE DRAWINGS

.

DESCRIPTION OF THE PREFERRED EMBODIMENT

Figure 1:
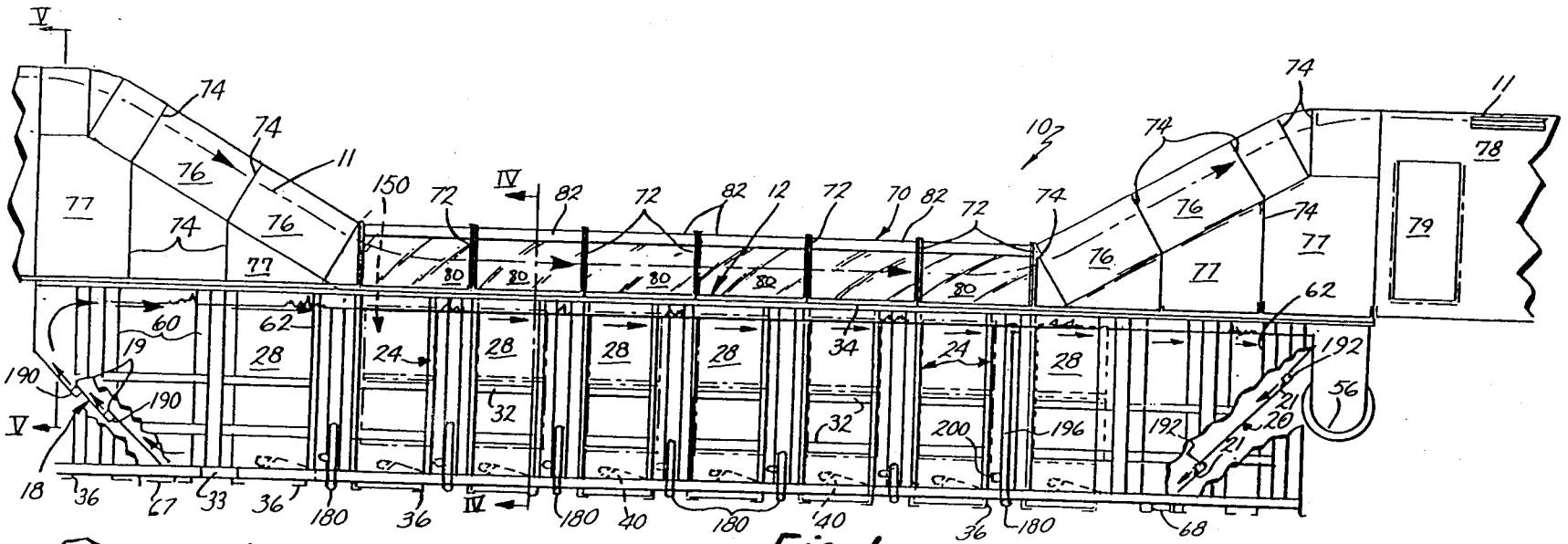
FIG. 1 is a side elevation of the electrodeposition coating apparatus of the present invention with portions broken away showing the end walls of the coating tank and the liquid level control weir at one end of the tank.
Figure 2:
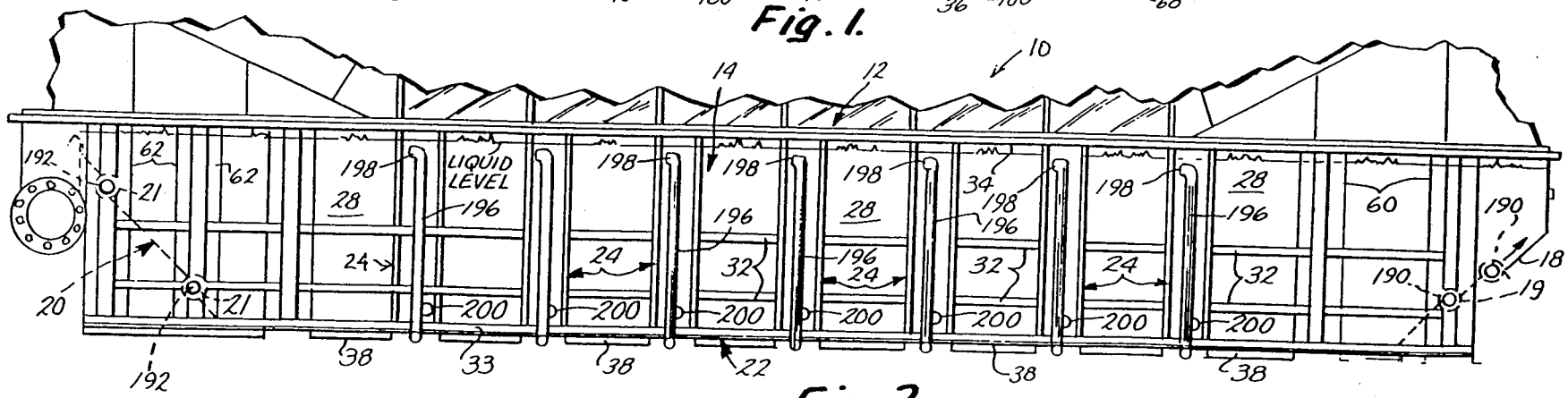
FIG. 2 is a side elevation of the opposite side of the electrodeposition coating tank opposite to that shown in FIG. 1 with portions broken away.
Figure 3:
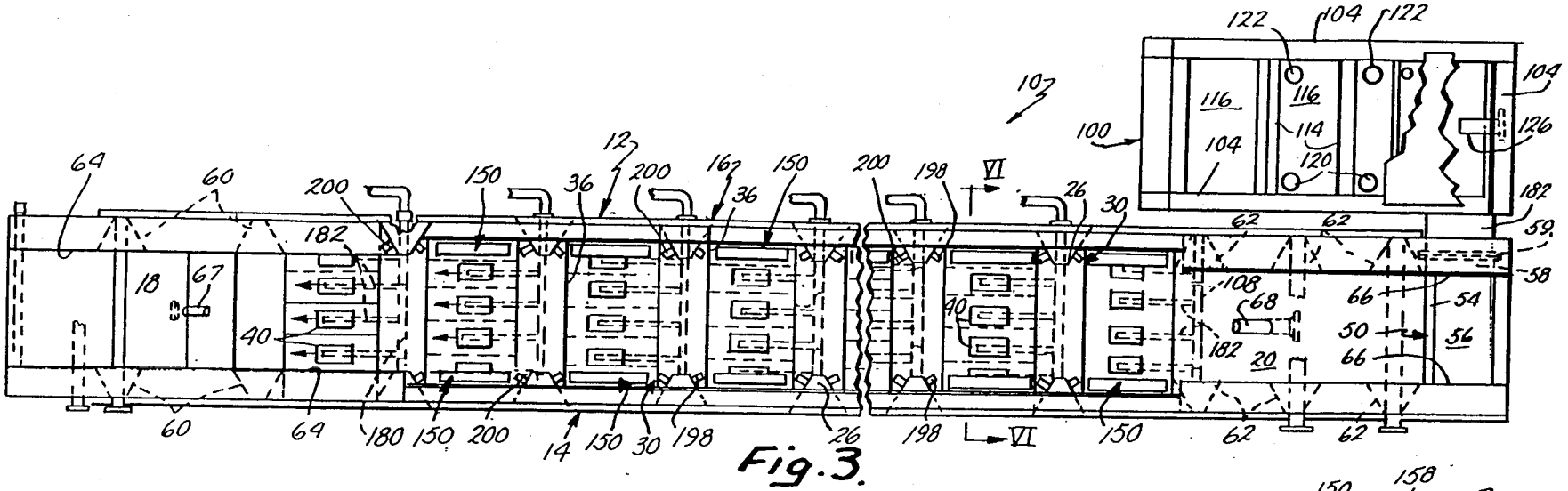
FIG. 3 is a broken, plan view of the electrodeposition coating apparatus shown in FIGS. 1 and 2.

Referring to the drawings in greater detail, FIGS. 1–3 illustrate the electrodeposition coating apparatus 10 of the present invention including an elongated electrodeposition coating tank 12 over which a conventional overhead conveyor 11 extends. Conveyor 11 slopes downwardly at the entrance end of tank 12 to a position above the tank but under cover 70 and slopes upwardly at the exit end of the tank. Parts or workpieces to be coated are suspended from conveyor 11 and prepared and cleaned by spraying with deionized water and the like at various stations along the conveyor in advance of the electrodeposition tank. The parts are then coated within the tank (see FIG. 4) and moved on the conveyor to drying areas following the coating tank. Preferably, the curved cover 70 over tank 12 is continuous with a curved cover extending over the cleaning and drying areas on either end of the tank. These curved covers allow any condensation or water spray which collects on the covers to run down the cover and sides and avoid dripping onto the painted workpieces in the tank area as well as the cleaning and drying areas.

Coating tank 12 includes opposing, parallel sidewalls 14, 16 and outwardly sloped end walls 18, 20 secured over bottom wall 22 all of which may be assembled on-site at the desired location from standard components. The tank is enclosed by a curved, multisection cover assembly 70 having a combination of curved stainless steel top panels and curved, slidable, removable, glass side panels. Curved, stainless steel end cover portions slope upwardly over end walls 18, 20 to cover the workpiece conveyor and the tank as the conveyor slopes downwardly into the tank and upwardly out of the tank at either end. A liquid circulation system for the liquid coating material to be contained in the tank 12 is provided including appropriate piping 196 on the exterior of the sidewalls 14, 16 and extending beneath the tank at 180 for connection to flow direction eductors and nozzles within the tank as shown in FIGS. 1–3 and 11. A liquid level control weir 50 is provided at the exit end 20 of the tank 12 for collecting overflow coating liquid and directing that liquid into a separate recirculation tank 100 best seen in FIGS. 3 and 8. Recirculation tank 100 includes appropriate recirculation pumps 118 and piping and is interconnected with the flow control system best seen in FIG. 13 explained below. Tank 12 provides recessed mounting areas 30 along the interior sidewalls of the tank for receiving electrode assemblies 150 for efficient contact with the coating liquid. Electrodes 150 are recessed to shield them against contact and damage and to avoid disruption or turbulence in the flow within the tank. This allows the tank to be smaller and requires a smaller quantity coating liquid and closer spacing of electrodes 150 to the workpieces which tends to improve electrical charge conduction and reduced power requirements.

As is best seen from FIGS. 1–7, each of the electrodeposition coating tank sidewalls 14, 16 is assembled from a series of hollow, vertical, V-shaped columns 24 which are positioned along the tank in opposed pairs. Each column 24 is an elongated channel having a tapered, inwardly extending portion 26 projecting into tank 12 beyond planar sidewall panels 28 which are welded to the side surfaces of the channels. The bottoms 29 of panels 28 (FIGS. 4, 6 and 11) slant inwardly to the bottom of the tank to prevent collection and buildup of solids and paint residue and allow easier washing and cleaning when the tank is empty. Columns 24 open outwardly toward the exterior of tank 12 and define a hollow interior 25 (FIG. 7) which receives a portion of the piping leading to flow direction eductors or nozzles within the tank in the liquid circulation system, as well as electrical cables and tubing for conducting anolyte liquid to the electrodes 150 suspended within the tank.

Figure 7:
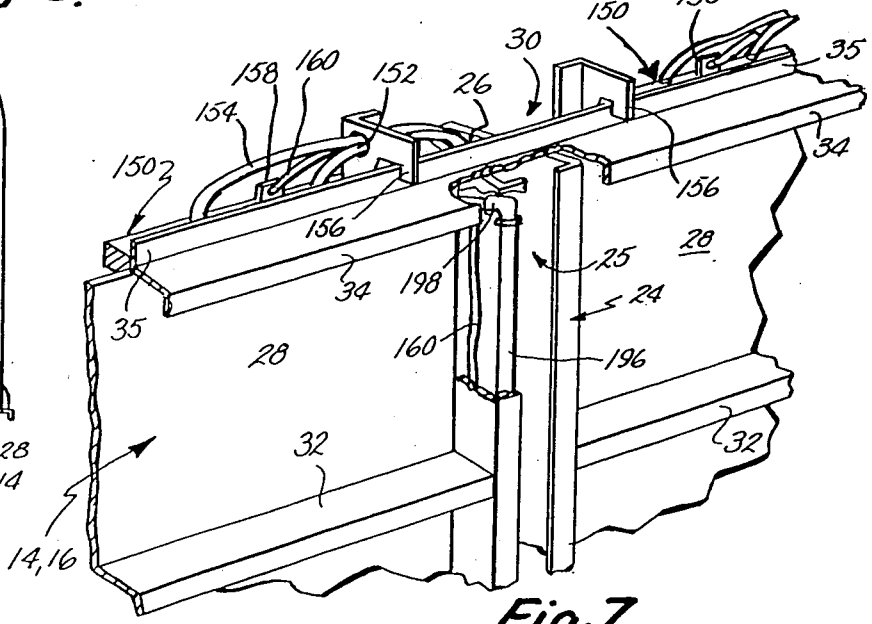
FIG. 7 is a fragmentary perspective view with portions broken away of the upper sidewall area of the electrodeposition coating tank.
Figure 4:
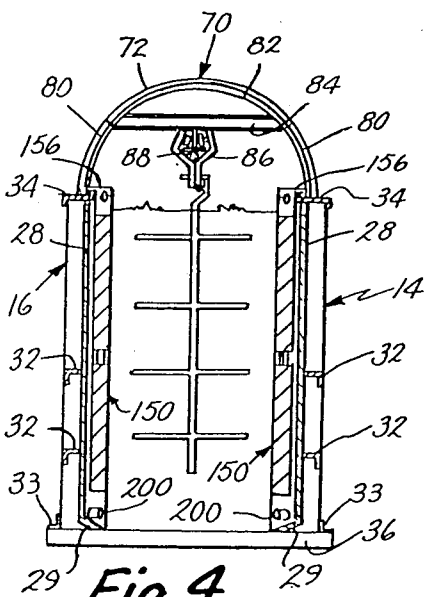
FIG. 4 is a sectional end elevation of the coating apparatus taken along plane IV—IV of FIG. 1.

As shown in FIGS. 3, 4 and 7, vertical sidewall panels 28 are spaced intermediate the innermost and outermost surfaces of each vertical column 24 and define recessed areas 30 between projecting ends 26 and the inside surfaces of the sidewall panels. The exteriors of panels 28 and columns 24 are reinforced by braces or channel members 32 which extend parallel to the top and bottom of the sidewalls along the length of each sidewall at two spaced positions above the bottom of the tank and lower reinforcing angles 33 extending along the feet of columns 24 as shown in FIGS. 1, 2, 4, 6 and 7. The top of each sidewall 14, 16 is finished with a top channel railing 34 which extends the full length of the tank along the upper edges of panels 28 and the top surfaces of columns 24 and across the weir end of the tank as shown in FIGS. 2, 3, 4, 7 and 9. The innermost, upwardly extending flange 35 (FIG. 7) of rails 34 provide a support from which electrodes 150 are suspended as explained hereinafter.

Figure 6:
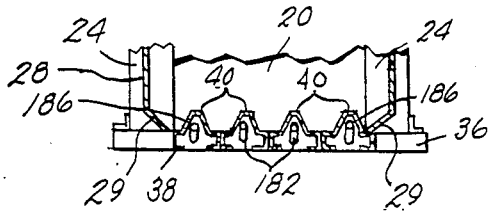
FIG. 6 is a sectional end view of the floor area of the electrodeposition coating tank taken along plane VI—VI of FIG. 3.
Figure 4A:
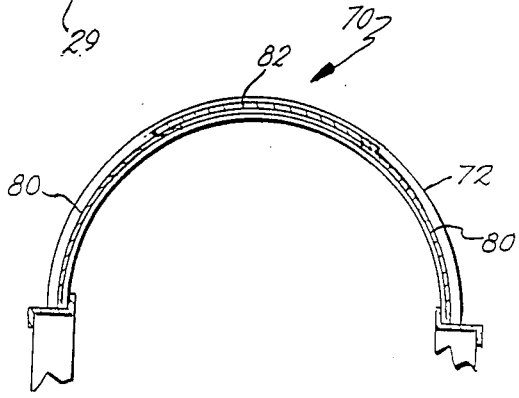
FIG. 4*a* is an enlarged sectional view of the cover assembly for the coating tank.
Figure 12:
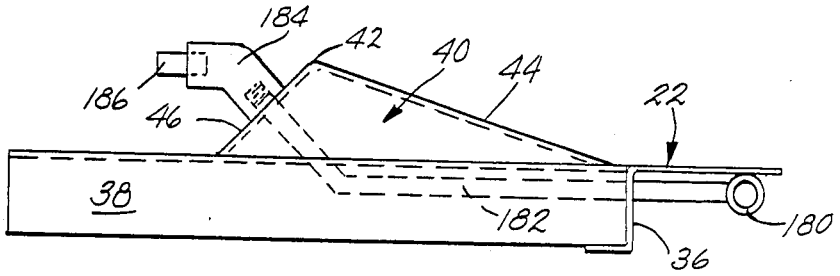
FIG. 12 is a side elevation of one of the flow direction nozzles and protective housings therefor in the floor of the electrodeposition coating tank.

The bottom of tank 12 is formed by a series of abutting channel members including laterally extending channels 36 aligned with the bottoms of vertical columns 24 and longitudinally extending channel members 38 which are fitted side by side across the width of the tank as shown in FIGS. 3 and 6. Each of the longitudinally extending channels 38 includes an upwardly projecting, formed sheet metal housing 40. As seen in FIG. 12, each housing 40 extends to an upward apex 42 at its top, tapers downwardly toward the bottom and the weir end of the tank along side 44, and has a sloped, forwardly facing surface 46 through which an eductor assembly 184, 186 extends for directing the flow along the bottom within the tank. Housings 40 are formed integrally with channel members 38 and provide protection for the eductor and related piping from heavy objects and workpieces being coated within the tank which may fall from support racks therein and otherwise damage the eductor piping at the bottom of the tank.

Figure 8:
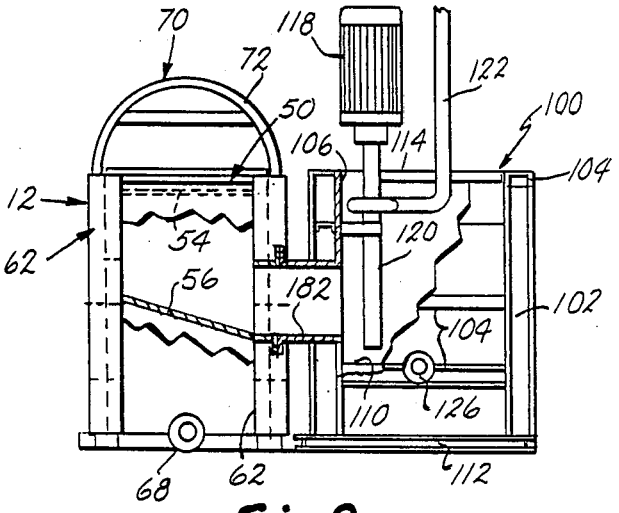
FIG. 8 is an elevation of the weir end of the electrodeposition coating apparatus with portions broken away.
Figure 10:
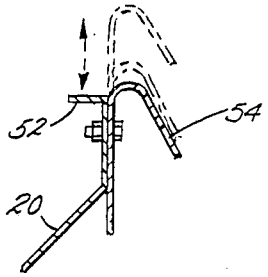
FIG. 10 is a fragmentary, enlarged side elevation of the weir shown in FIG. 9.
Figure 9:
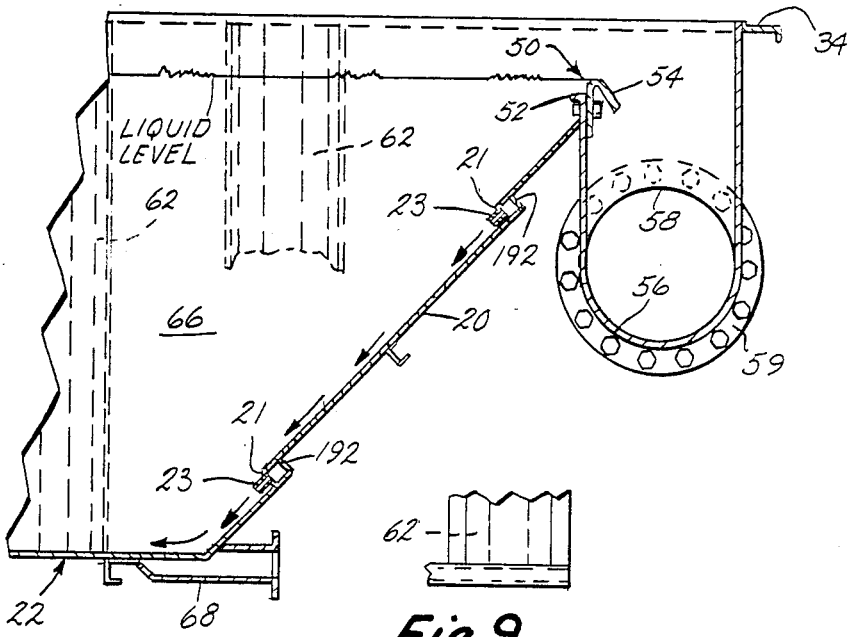
FIG. 9 is a fragmentary, sectional side elevation of the liquid level control weir at one end of the electrodeposition coating tank.

As is best seen in FIGS. 1–3, outwardly sloped end walls 18, 20 close the ends of the tank. Each end wall includes a pair of spaced steps therein. End wall 18 has upwardly facing steps 19 while end wall 20 has downwardly facing steps 21. Steps 19, 21 provide areas for mounting flow direction nozzles 23 (FIGS. 9 and 11) which insert coating liquid from the recirculation system into the tank and direct the fluid flow upwardly along end 18 and downwardly along wall 20 away from the weir. Wall 18 extends upwardly to the top edge of the tank as shown in FIGS. 1 and 2. However, as is best seen in FIG. 9, opposite end 20 slants upwardly to a weir 50 including a vertical wall 52 and an adjustable V-shaped weir section 54 which is bolted to wall 52. As illustrated in FIGS. 9 and 10, the bolts on weir 50 may be loosened and weir section 54 raised or lowered to control the level of liquid within the tank as seen in FIG. 9. Any coating liquid which flows over weir member 54 is received in downwardly extending trough 56 which extends beyond the weir member and the end wall 20 as shown in FIGS. 1, 2, 8 and 9. Weir section 54 allows flow into trough 56 but creates little turbulence upstream of the weir. Hence, the liquid coating material in tank 12 does not foam adjacent the weir thereby avoiding degradation of any painted parts which are lifted out of the tank through that area on conveyor 11.

Trough 56 is connected to a large diameter pipe or fluid conduit 58 which extends to one side of tank 12 and includes a flange 59 for connection to a similar fluid pipe 182 leading to separate recirculation tank 100 as shown in FIG. 3. As shown in FIG. 8, trough 56 slopes downwardly toward pipe 58 and flange connection 59 to convey the overflow coating liquid into the separate recirculation tank 100. Additional support is provided by supplemental vertical columns 60 at end 18 and 62 at end 20 which are reversed in position from columns 24. Thus, columns 60, 62 point outwardly and receive inner sidewall panels 64, 66 across their inner sides to form a slightly narrower tank width at the ends of the tank as shown in FIG. 3. Sidewall panels 64 extend across the inner end of the final vertical column 24 at the entrance end of the tank near wall 18 as is also shown in FIG. 3. Each of the ends 18, 20 includes a respective recessed drain 67, 68 for removing liquid from the tank when desired as shown in FIGS. 1–3, 8 and 9.

As will now be understood, tank 12 may be assembled on-site at a desired location by fitting and welding together sidewall panels 28, 64 and 66 with vertical columns 24, 60 and 62 resting atop laterally extending bottom channels 36 and longitudinally extending channel members 38 to form a tank of the desired length for the specific application. Such panels and members need only be welded together at spaced intervals since watertight joints are unnecessary in view of the use of a tank liner described below. This speeds construction and lowers cost. After such assembly, the entire interior of tank 12 is spray-coated or otherwise lined with a layer of fiberglass or other dielectric coating to provide a liquid-tight coating which seals the tank and provides electrical insulation which prevents shorting through the paint to the steel tank walls.

As is best seen in FIGS. 1, 4, 4*a*, 5 and 8, tank 12 is provided with a cover assembly 70 for retaining coating liquid within the tank area and preventing entry of contaminants including dirt, foreign objects and the like. Cover 70 includes a framework of spaced, semi-circular, curved, T-shaped rib members 72 which extend from the top of sidewall 14 to the top of sidewall 16 over and along the tank as seen in FIGS. 4 and 8. The framework extends upwardly at either end of the tank generally parallel to the upward slant of ends 18, 20 with interconnected framework members 74 supporting the sloped framework also formed from T-shaped ribs. Supported by framework 74 are a series of curved, stainless steel sheet panels 76 and vertical stainless steel side panels 77 which are tack-welded to the framework and extend over the ends of the tanks 18, 20 for connection with curved sheet metal covers 78 extending over the workpiece preparation areas and final rinse areas after coating as shown in FIGS. 1 and 2. As above, curved covers 78 allow condensation and spray water in these areas to run down the side panels 77 without dripping on the prepared or painted parts as occurred with prior flat roofed enclosures. An access door 79 is provided to the interior of cover 78.

In the center section over the main portion of coating tank 12 cover 70 is semi-circular and includes a series of curved, transparent glass or plastic panels 80 which are slidably mounted on the horizontal flanges of T-ribs 72 below and on either side of a series of curved, stainless steel roof panels 82. Accordingly, transparent panels 80 extend under panels 82 and allow visual inspection of the operation within the tank without opening, but may be slid upwardly beneath stainless steel roof panels 82 on framework 72 to open and obtain access to the interior of the tank and removal of equipment therefrom when desired. Preferably, panels 80, 82 each cover about 60 degrees of the full 180 degree extent of cover 70. Alternately, transparent panels 80 may be entirely removed from the framework for cleaning or access to the tank for maintenance purposes.

Because the operation of the electrodeposition coating tank and related equipment normally imparts heat to the coating liquid within the tank and the cover 70 interfaces with the cooler surrounding temperature, condensation due to evaporation from the tank on the inside of the cover normally occurs. With a flat cover, such condensation drips onto the workpieces as they enter or leave the tank area. However, the curved cover over the tank and which extends upwardly and downwardly at the ends of the tank causes any condensation to run down the sides of the cover and back into the tank area without dripping on the workpieces which are suspended within the tank.

Figure 5:
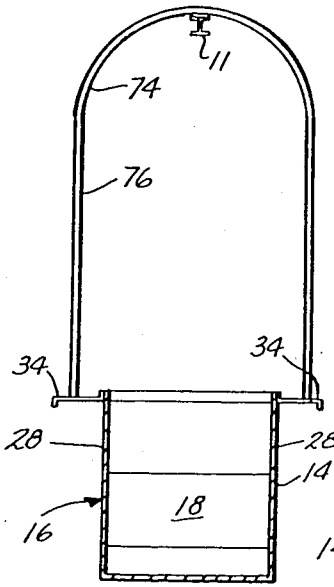
FIG. 5 is a sectional end elevation of another portion of the electrodeposition coating apparatus taken along plane V—V of FIG. 1.

As shown in FIGS. 4 and 5, I-beam conveyor track 11 is supported over the center of the tank on either framework 74 or cross support beams 84 welded across the interior of framework 72 over the main tank area as shown therein. I-beam conveyor track 11 supports conventional trolley units 86 which receive a conducting cable 88 resting therein for electrically grounding those trolley members. Suspended workpiece support racks 89 and any workpieces to be coated hung thereon are also grounded by cable 88. The racks and supported workpieces extend downwardly into the tank area below the coating liquid level and between the opposed banks of electrodes 150 as shown in FIG. 4.

Referring now to FIGS. 3 and 8, recirculation collection tank 100 which communicates with overflow collection trough 56 via fluid pipes 58, 182 is a rectangular tank supported adjacent to the weir end of main coating tank 12. Tank 100 includes a series of vertical support channels 102 between which are welded or otherwise secured horizontal support channels 104 all of which support side and end wall panels 106, 108 to form the tank interior. A floor panel 110 is spaced above bottom channels 112 which support the tank such that floor 110 is immediately below the outlet of pipe 182 which connects to trough 56 and the main coating tank 12 via flange 59. A series of cross channels 114 extend over the top of tank 100 and support top panels 116 on which are mounted vertical centrifugal pumps 118. Pumps 118 include vertically extending collection pipes 120 which project close to floor 110 within the tank and below the outlet of pipe 182. Pumps 120 lift recirculated liquid from tank 100 through exit pipes 122 which extend through top panels 116 of the tank at positions spaced from pumps 118 and collection pipes 120 as shown in FIG. 8. One or more of the panels along the top of tank 100 may be removed as shown at 124 to provide access into the tank interior. A recessed drain 126 is provided at one end of the tank at floor level for removing liquid from the tank. Coating liquid which flows over weir 50 and is collected in tank 100 and picked up with pump 118, flows from exit pipe 122 through appropriate filters and back into tank 12 as explained in connection with FIG. 13.

Figure 11:
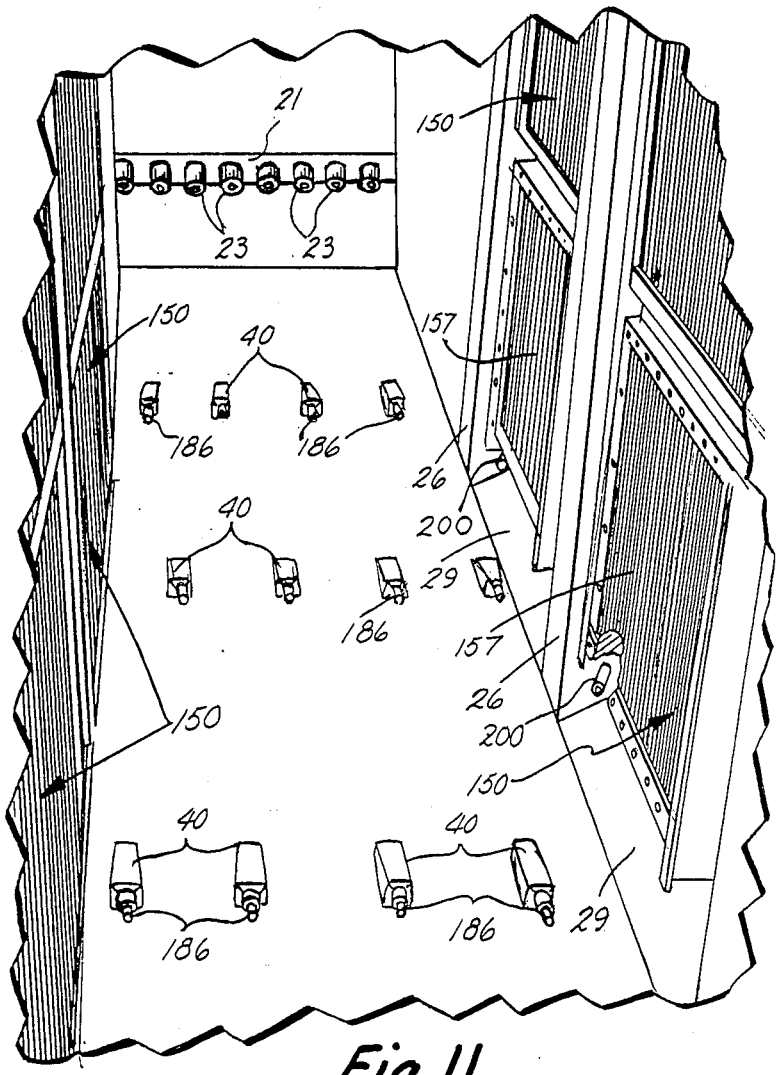
FIG. 11 is a perspective view of the interior of the electrodeposition coating apparatus illustrating the flow direction nozzles and recessed electrodes along the interior sides, end and bottom of the tank.

Referring now to FIGS. 3, 7 and 11, each of the electrodes 150 is preferably a modular anode membrane box as described in U.S. Pat. No. 4,284,493, issued Aug. 18, 1982 to Case et al., the disclosure of which is hereby incorporated by reference herein. Each anode box or electrode assembly includes top, bottom, side and back walls preferably formed from polyvinylchloride or other chemically resistant material, and a front wall closed by an ion selective membrane well-known in the art. Each membrane unit is supplied, as explained below, with an anolyte liquid comprising deionized water from an inlet hose 152 which extends downwardly through the units to the bottom and fills the units from the bottom toward the top. The anolyte liquid or deionized water is returned to an anolyte liquid supply through a return hose 154. Hoses 152, 154 extend upwardly along the exterior of tank 12 through the conduit passageways 25 formed by vertical columns 24, out the top ends of the columns adjacent the inner surface of top rail 34, and through apertures in appropriate hanger brackets 156 to the electrode membrane boxes 150. Hanger brackets 156 mount over the upwardly extending flange 35 of top rail 34 and allow the electrode units to hang downwardly within recesses 30 substantially parallel to but spaced from the inner surfaces of sidewalls 14, 16 between column projections 26 as mentioned above.

The inner side of electrode units 150 are covered with a grill construction 157 (FIG. 11) including rigid, spaced vertical and horizontal members which protect the membrane on the front side of each electrode but allow the coating liquid to contact the membrane. Within each electrode assembly is positioned an electrode panel (not shown) which is bolted to an electrical connection strip 158 which extends above the electrode assembly adjacent the top of the tank. Strip 158 is connected to an appropriate electrical cable 160 which passes through hanger bracket 156 and interior conduit passageway 25 of vertical column 24 to an appropriate electrical supply to provide the necessary electrical voltage to charge the coating liquid within tank 12 for proper adherence to the oppositely charged workpieces suspended from conveyor 11 as mentioned above.

Electrode members 150 project no farther into the tank than the ends of inner column projecting portions 26 and, therefore, are confined within recessed areas 30. This avoids cumbersome internal tank rails or guards which previously have been required to protect anode boxes in tanks from contact with racks or workpieces within the tank during use. This also provides a flow passageway along the center of tank 12 which is unimpeded by any obstructions, piping or the like and increases the flow efficiency of the coating liquid therethrough for maintenance of a proper coating mixture/solution and proper contact with the workpieces to be coated because of minimized flow disruption and turbulence.

With reference to FIGS. 1, 3, 4, 6 and 11, the liquid coating material within tank 12 is circulated in a continuous flow path around and through tank 12. Such flow extends along the bottom of the tank away from the weir end 20 toward end 18, upwardly along sloped end wall 18 to the top surface of the liquid, in the opposite direction along the top of the tank toward weir end 20 and then downwardly along wall 20 toward the bottom in an endless path. Circulation is accomplished through a series of flow directing nozzles or eductors through which recirculated coating liquid is pumped to cause the flow within the tank. Along the bottom are a series of laterally extending cylindrical pipes 180 (FIGS. 1 and 12) which extend through channels 36 across the width of the tank therebeneath. As shown in FIG. 12, each pipe 180 includes a series of four longitudinally extending branch pipes 182 extending toward end 18 from pipe 180 through channels 38 where they bend upwardly and extend through housings 40 to housing front surface 46. Angled elbow fittings 184 are threaded on the extending end of branch pipes 182 with eductors 186 extending from the elbow fittings on the downstream side. Accordingly, coating liquid recirculated from tank 100 by pumps 118 is returned to tank 12 along the bottom through eductors 186 which direct the liquid flow within the tank longitudinally along the bottom away from end 20 and toward end 18.

Eductors 186 are preferably those sold under Model CTE by Penberthy Division of Houdaille Industries, Prothestown, Ill. Such eductors create high velocity flow by producing approximately four times greater backpressure than free flowing nozzles. This enhances flow along the tank bottom.

Flow upwardly along end 18 and downwardly along end 20 is aided by fluid conduits 190, 192 which extend laterally across those respective ends for communication with spaced openings which extend through steps 19, 21 and cylindrical flow direction nozzles 23 (FIGS. 9 and 11) having central fluid passageways spaced across each of those steps. As coating liquid from the recirculation system is pumped through conduits 190, 192, the liquid passes through the openings in steps 19, 21 and the nozzles 23 and is directed either upwardly or downwardly respectively along the end walls. Nozzles 23 are of the free flowing type without significantly increased backpressure as opposed to eductors 186.

Flow along the top of the tank toward weir end 20 and along the bottom of the tank away from weir end 20 is aided by an additional series of eductors 198 which project toward and away from end 20 respectively from each of the vertical columns 24 into electrode recesses 30 above electrodes 150 as shown in FIGS. 2, 3, 4, 7 and 11. Eductors 198 are of the same type as eductors 186. Circulation pipes 196 extend upwardly through each of the vertical columns 124 therewithin on either side of tank 12 and communicate with eductors 198 which extend at an angle outwardly from the side surfaces of V-shaped channels 24 toward weir end 20 as shown in FIG. 3. Recirculated coating liquid pumped through eductors 198 thus urges flow along the top of the liquid in the tank toward the weir end.

Flow along the bottom sides of the tank is aided by eductors 200 which connect to pipes 196 (FIGS. 3 and 11) in columns 24 and project through inwardly projecting ends 26 of columns 24 away from the weir end also into electrode recesses 30. Eductors 200 are of the same type as eductors 186 and 198. Eductors 198, 200 are positioned above and below electrodes 150 but do not extend beyond the innermost surfaces of columns 24 to help minimize flow disruption or turbulence within the tank. Eductors 198, 200 direct recirculated coating liquid past the electrodes toward the respective ends of the tank to aid the overall endless circulation flow as described. As will be apparent, housings 40 are streamlined in the direction of flow within the tank. No piping which would impede flow through the tank is located within the tank other than recessed or streamlined eductors 186, 198 and 200. Likewise, electrodes 150 are recessed behind the ends of inwardly projecting column ends 26 such that the entire center area of the tank may be accessed by workpiece support racks such as those at 89 in FIG. 4. Moreover, the amount of coating liquid within tank 12 is less overall than with prior tanks handling similar workpiece capacities thereby reducing initial start-up and tank filling costs.

Figure 13:
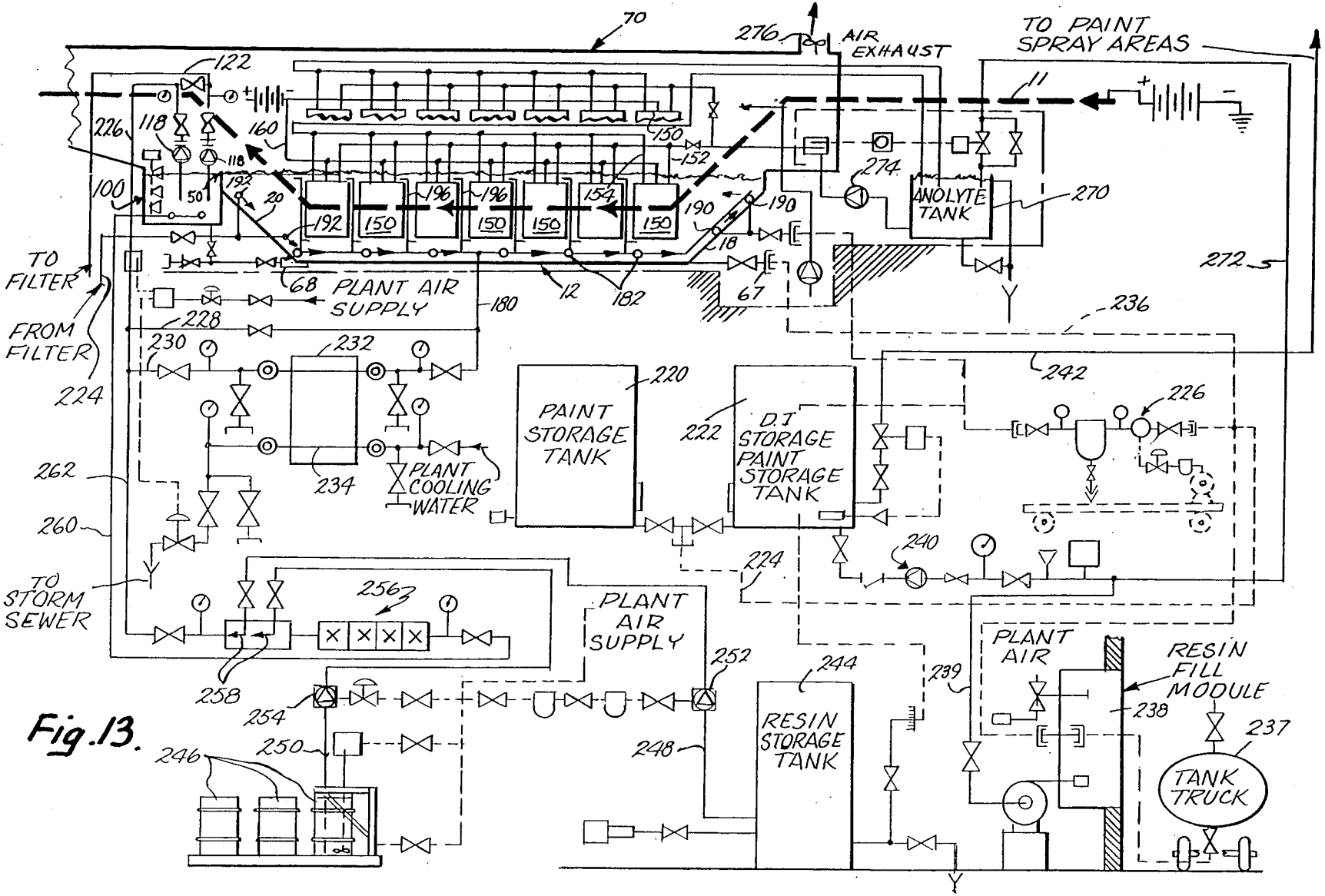
FIG. 13 is a schematic drawing of the overall electrodeposition coating apparatus and system.

Referring now to FIG. 13, operation of the electrodeposition coating apparatus 10 within an operating system will be understood. Tank 12 is filled with a liquid coating material such as that of the type including a water base comprised of a mixture of deionized water, a suitable resin and a paste carrier. One preferred liquid paint which can be used in the system is Uniprime 600 obtained from the Coatings and Resins Division of PPG Industries, Inc. of Springdale, Pennsylvania. The coating liquid within tank 12 is retained at a controlled temperature. In the preferred embodiment, coating material is placed within tank 12 from paint storage tank 220 and/or deionized water storage tank 222. Filling occurs through appropriate valving and pipe 224 which extends through appropriate liquid sampling equipment 226 and additional valving to conduits 190 at the entrance end 18 of tank 12. Tank 222 may be used either for storage of deionized water or additional paint storage as required in the system. When the tank 12 is completely filled the liquid circulation system is activated as follows: Overflow liquid coating material is received in circulating tank 100 from which it is pumped by pumps 118 upwardly out of the tank through pipes 122 to an appropriate filter module (not shown). Filtered recirculated liquid coating material reenters the system through pipe 224 and appropriate control valving through conduits 192 and nozzles 23 which expel liquid downwardly along end 20 as illustrated.

Alternately, a valve may be closed to pipe 122 adjacent pumps 118 causing liquid coating material from tank 100 to flow through lines 226, 228 and/or 230. When the valve in line 228 is open, recirculated liquid coating material is passed therethrough to pipes 180 beneath tank 12 which lead to branch pipes 182 and the flow directing eductors 186 along the bottom of the tank to urge the flow as described above.

Alternately, should the valve in line 228 be closed, coating liquid flows through line 230 and appropriate valving and an appropriate cooling unit 232 conventionally known in the art. Cooling unit 232 is of the type having a number of coils or pipes through which the liquid coating material passes and over which is passed plant cooling water shown schematically as line 234 in FIG. 13. Cooling unit 232 maintains the temperature of the coating liquid at the desired range of between about 75 and 90 degrees F., preferably 82 to 85 degrees F. The temperature would otherwise increase due to the electrical charge imparted by electrodes 150 as described above coupled with heat from the prepared workpieces and conveyor parts. Should draining of tank 12 be desired, it can be accomplished through drain 67 and line 236 which leads back to the fill module 238 where it may be inserted in a tank truck 237 or other container as desired. Should replenishment of the liquid coating material and/or deionized water be necessary from external tanks, such as tank truck 237, filling module 238 allows connection to external containers such that storage tank 222 is filled through pipe 239 and pump and valving controls 240. In addition, tank 222 supplies deionized water to workpiece preparation spray areas through piping 242 as desired.

Should replenishment of the content of the coating liquid or paint be desired, resin stored in tank 244 and paste from storage barrels 246 may be directed through pipes 248, 250 and appropriate pumps 252, 254 to a static mixture module 256. Module 256 includes appropriate valving and mixing injection heads 258 for injecting appropriate quantities of paste and resin for replenishing the liquid coating material to its desired consistency and composition. The paste and resin are injected into a stream of liquid coating material withdrawn from tank 100 via pipe 260 and mixed with the paste and resin at heads 258. The replenished mixture is then conducted via pipe 262 back to recirculation lines 228 and/or 230 for reintroduction to tank 12 preceded by cooling with cooling unit 232 if necessary.

As is also shown in FIG. 13, a system for pumping anolyte liquid to electrode/anode assemblies 150 is provided. An anolyte tank 270 may be filled with deionized water or anolyte liquid from storage tank 222 via line 272 when necessary. Anolyte liquid or deionized water is pumped from tank 270 with an appropriate pump 274 to insertion tubes 152 for each of the electrode units 150 as described above. Anolyte liquid is returned from electrode units 150 through tubes 154 which return the liquid to tank 270. Appropriate electrical connections are also provided to each of the electrode units as described above at 160 such that each electrode unit is charged with a negative charge while the main conveyor includes an oppositely charged, grounding cable. Electrode units 150 charge the coating liquid within tank 12 with a negative charge while the workpieces which are in electrical connection with the grounded suspending conveyor are oppositely charged. Thus, paint particles in the coating liquid suspension are strongly attracted to the workpieces for proper paint adherence. An exhaust fan 276 may be provided within cover 70 over the tank 12 for proper ventilation over the tank.

Other forms of electrode units besides those described for the above preferred embodiment and referenced in U.S. Pat. No. 4,284,493 may be used without departing from the spirit of the invention.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. In an enclosed painting/coating system adapted to receive workpieces for painting/coating including a tank for receiving a liquid coating material, the tank having sides, ends and a middle, and enclosed workpiece preparation areas and rinsing areas at the ends of said tank ahead of and following said tank, the improvement comprising:

cover means for covering said tank and workpiece preparation and rinsing areas, said cover means including an upwardly curved configuration extending from the top of the sides of said tank over the middle of said tank and having its greatest height over the middle of said tank and preparation and rinsing areas whereby condensation spray which collects on the inside of said cover means will run down the sides of said cover and enclosures for said areas and avoid dripping on prepared or paninted workpieces;

said cover means including movable panel means positioned adjacent said tank sides, said panel means being curved and contoured to and following the shape of said cover means and extending from adjacent at least one portion of the top of said tank sides to a position over said tank for providing access to the interior of said cover means and tank from adjacent said tank sides for maintenance purposes.

2. The improvement of claim 1 wherein said cover means has a semi-circular shape in section.

3. the improvement of claim 2 wherein said tank includes sidewalls, said cover means being secureed to the tops of said sidewalls and extending over said tank, said cover means also including a first permanently positioned portion; said movable panel means including a second slidably movable portion, said second portion being adjacent said sidewall tops and allowing access to the interior thereof and said tank.

4. The improvement of claim 3 wherein said cover means curves from side to side over said tank; said second portion of said cover means includes a framework extending over said tank and at least one transparent, curved panel slidably mounted on said framework.

5. The improvement of claim 4 including a plurality of curved, transparent panels mounted side by side along the length of each side of said tank on said framework, said transparent panels being mounted in opposing pairs, each transparent panel extending partially over said tank; said first portion of said cover means including at least one fixed roof panel extending over the center of said tank between said transparent panels in said opposing pairs.

* * * * *